US010140920B2

(12) United States Patent
Gai et al.

(10) Patent No.: US 10,140,920 B2
(45) Date of Patent: Nov. 27, 2018

(54) PIXEL DRIVING CIRCUIT, DISPLAY DEVICE AND PIXEL DRIVING METHOD

(71) Applicant: BOE TECHNOLOGY GROUP CO., LTD., Beijing (CN)

(72) Inventors: Cuili Gai, Beijing (CN); Liye Duan, Beijing (CN); Xiaodi Liu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/321,543

(22) PCT Filed: Mar. 24, 2016

(86) PCT No.: PCT/CN2016/077189
§ 371 (c)(1),
(2) Date: Dec. 22, 2016

(87) PCT Pub. No.: WO2016/161896
PCT Pub. Date: Oct. 13, 2016

(65) Prior Publication Data

US 2017/0206838 A1 Jul. 20, 2017

(30) Foreign Application Priority Data

Apr. 10, 2015 (CN) ..... 2015 1 0169294

(51) Int. Cl.
*G09G 3/3258* (2016.01)
*G09G 3/3225* (2016.01)

(52) U.S. Cl.
CPC ..... *G09G 3/3258* (2013.01); *G09G 3/3225* (2013.01); *G09G 2300/0426* (2013.01);
(Continued)

(58) Field of Classification Search
CPC ..... G09G 3/30; G09G 3/32; G09G 3/3208; G09G 3/3225; G09G 3/325; G09G 3/3258;
(Continued)

(56) References Cited

U.S. PATENT DOCUMENTS

2005/0052365 A1 3/2005 Jang
2005/0243036 A1* 11/2005 Ikeda ..... G09G 3/3233 345/76

(Continued)

FOREIGN PATENT DOCUMENTS

CN 1684558 A 10/2005
CN 101405785 A 4/2009

(Continued)

OTHER PUBLICATIONS

Search Report in Chinese Application No. 201510169294.5 dated Sep. 7, 2015, with English translation.

(Continued)

*Primary Examiner* — Jason Mandeville
(74) *Attorney, Agent, or Firm* — Womble Bond Dickinson (US) LLP

(57) ABSTRACT

Embodiments of the present disclosure provide a pixel driving circuit and a pixel driving method. The pixel driving circuit comprises a driving transistor, a storage capacitor, a light-emitting device, a first switch transistor, a second switch transistor, a third switch transistor, a fourth switch transistor and a fifth switch transistor. The pixel driving circuit and the pixel driving method are implemented such that a driving current generated by the driving transistor is relevant to a working voltage provided by a first power supply terminal, an activation voltage of the light-emitting device, a working voltage of the light-emitting device upon emitting light and a data voltage, yet irrelevant to a threshold (Continued)

voltage of the driving transistor, thereby refraining the driving current flowing through the light-emitting device from influence exerted by the non-uniformity and drifting of the threshold voltage of the driving transistor, and in turn effectively improving the uniformity of the driving current flowing through the light-emitting device.

5 Claims, 4 Drawing Sheets

(52) U.S. Cl.
CPC ..... *G09G 2300/0814* (2013.01); *G09G 2300/0819* (2013.01); *G09G 2300/0861* (2013.01); *G09G 2310/0262* (2013.01); *G09G 2320/0233* (2013.01); *G09G 2320/043* (2013.01); *G09G 2320/045* (2013.01)

(58) Field of Classification Search
CPC ..... G09G 3/3283; G09G 3/3291; G09G 2300/08; G09G 2300/0809; G09G 2300/0814; G09G 2300/0819; G09G 2320/0233; G09G 2320/045; G09G 2300/0861; G09G 2300/0426; G09G 2320/043; G09G 2310/0262
USPC ..... 345/76–77, 82–83, 214
See application file for complete search history.

(56) References Cited

U.S. PATENT DOCUMENTS

| | | | | |
|---|---|---|---|---|
| 2011/0164071 | A1 | 7/2011 | Chung et al. | |
| 2014/0146029 | A1* | 5/2014 | Hong ..... | G09G 3/3233 345/212 |

FOREIGN PATENT DOCUMENTS

| | | | |
|---|---|---|---|
| CN | 102473376 | A | 5/2012 |
| CN | 102708794 | A | 10/2012 |
| CN | 103927984 | A | 7/2014 |
| CN | 104217677 | A | 12/2014 |
| CN | 104318899 | A | 1/2015 |
| CN | 104751798 | A | 7/2015 |

OTHER PUBLICATIONS

International Search Report with English Language Translation, dated Jun. 21, 2016, PCT Application No. PCT/CN2016/077189.
Chinese Office Action with English Language Translation, dated Nov. 16, 2015, Chinese Application No. 201510169294.5.

* cited by examiner

PIXEL DRIVING CIRCUIT, DISPLAY DEVICE AND PIXEL DRIVING METHOD

The present application is the U.S. national phase entry of PCT/CN2016/077189, with an international filing date of Mar. 24, 2016, which claims the benefit of Chinese Patent Application No. 201510169294.5, filed on Apr. 10, 2015, the entire disclosures of which are incorporated herein by reference.

TECHNICAL FIELD

The present disclosure relates to the field of display technologies, and particularly to a pixel driving circuit, a display device and a pixel driving method.

BACKGROUND

Active Matrix Organic Light Emitting Diode (AMOLED) panel are applied more and more extensively. The pixel display device of the AMOLED panel is an organic light-emitting diode (OLED). The AMOLED panel emits light by driving a thin film transistor to generate a driving current in a saturated state to drive the OLED to emit light. FIG. 1 is a structural schematic diagram of a pixel driving circuit in the prior art. As shown in FIG. 1, the existing pixel driving circuit employs a 2T1C circuit which includes two thin film transistors (a switch transistor T0 and a driving transistor DTFT) and a storage capacitor C.

However, in the current low-temperature polycrystalline silicon process, undesirable uniformity of the threshold voltages Vth exists among individual driving transistors DTFT on a display substrate and the threshold voltages even drift during use. As such, when a scanning line controls the switch transistor T0 to turn on to input the same data voltage Vdata to respective driving transistors DTFT, uniformity of the luminance of the AMOLEDs may be undesirable due to their different driving currents resulting from the variation of the threshold voltage Vth of the driving transistors DTFT.

In addition, the OLEDs gradually age over time, which leads to attenuation of the display luminance of the OLEDs and in turn affects the user's use.

SUMMARY

Embodiments of the present disclosure provide a pixel driving circuit, a display device and a pixel driving method, which may effectively eliminate influence exerted by a threshold voltage of the driving transistor on the driving current of a light-emitting device, and solve the problem of attenuation of the display luminance caused by the aging of the light-emitting device.

To achieve this, embodiments of the present disclosure provide a pixel driving circuit, including a driving transistor, a storage capacitor, a light-emitting device, a first switch transistor, a second switch transistor, a third switch transistor, a fourth switch transistor and a fifth switch transistor. A control electrode of the first switch transistor is connected with a second scanning line, a first electrode of the first switch transistor is connected with a first power supply terminal, and a second electrode of the first switch transistor is connected with a first terminal of the storage capacitor. A control electrode of the second switch transistor is connected with a third scanning line, a first electrode of the second switch transistor is connected with the first power supply terminal, and a second electrode of the second switch transistor is connected with a first electrode of the driving transistor and a first electrode of the third switch transistor. A control electrode of the third switch transistor is connected with a first scanning line, the first electrode of the third switch transistor is connected with the first electrode of the driving transistor, and a second electrode of the third switch transistor is connected with a control electrode of the driving transistor and a second terminal of the storage capacitor. A control electrode of the fourth switch transistor is connected with the first scanning line, a first electrode of the fourth switch transistor is connected with a data line, and a second electrode of the fourth switch transistor is connected with the first terminal of the storage capacitor. A control electrode of the fifth switch transistor is connected with a fourth scanning line, a first electrode of the fifth switch transistor is connected with a second electrode of the driving transistor, and a second electrode of the fifth switch transistor is connected with a first terminal of the light-emitting device. The second terminal of the storage capacitor is connected with the control electrode of the driving transistor, and a second terminal of the light-emitting device is connected with a second power supply terminal. The first power supply terminal is used to provide a working voltage, and the second power supply terminal is used to provide a reference voltage.

The driving transistor, the first switch transistor, the second switch transistor, the third switch transistor, the fourth switch transistor and the fifth switch transistor may be independently selected from a polycrystalline silicon thin film transistor, a noncrystalline silicon thin film transistor, an oxide thin film transistor and an organic thin film transistor.

The driving transistor may be an N-type thin film transistor.

The first switch transistor, the second switch transistor, the third switch transistor, the fourth switch transistor and the fifth switch transistor may each be an N-type thin film transistor.

The first switch transistor may be a P-type thin film transistor, and the second switch transistor, the third switch transistor, the fourth switch transistor and the fifth switch transistor may each be an N-type thin film transistor.

The first scanning line and the second scanning line may be the same scanning line.

To achieve the above purpose, embodiments of the present disclosure further provide a display device including a pixel driving circuit which employs the pixel driving circuit as described above.

To achieve the above purpose, embodiments of the present disclosure further provide a pixel driving method. The pixel driving method is based on a pixel driving circuit which employs the pixel driving circuit as described above. The pixel driving method comprises: in a data write phase, the first switch transistor and the fifth switch transistor are turned off, the second switch transistor, the third switch transistor and the fourth switch transistor are turned on, a data voltage on the data line is written to the first terminal of the storage capacitor through the fourth switch transistor, and the working voltage provided by the first power supply terminal is written to the second terminal of the storage capacitor through the second switch transistor and the third switch transistor; in a compensation write phase, the first switch transistor and the second switch transistor are turned off, the third switch transistor, the fourth switch transistor and the fifth switch transistor are turned on, and the driving transistor discharges to write a compensation voltage including a threshold voltage of the driving transistor to the second terminal of the storage capacitor; and in a display phase, the third switch transistor and the fourth switch transistor are turned off, the first switch transistor, the second switch transistor and the fifth switch transistor are turned on, the working voltage provided by the first power supply terminal is written to the first terminal of the storage capacitor through the first switch transistor, a control voltage is output from the second terminal of the storage capacitor to the driving transistor, and the driving transistor generates a driving current under control of the control voltage to drive the light-emitting device to emit light.

The present disclosure has the following advantageous effects.

Embodiments of the present disclosure provide a pixel driving circuit and a pixel driving method, which are implemented such that when the driving transistor drives the light-emitting device to perform pixel display, the driving current generated by the driving transistor is relevant to the working voltage provided by the first power supply terminal, the activation voltage of the light-emitting device, the working voltage of the light-emitting device upon emitting light and the data voltage, yet irrelevant to the threshold voltage of the driving transistor, thereby refraining the driving current flowing through the light-emitting device from influence exerted by the non-uniformity and drifting of the threshold voltage of the driving transistor, and in turn effectively improving the uniformity of the driving current flowing through the light-emitting device. In addition, when the activation voltage of the light-emitting device increases with the aging of the light-emitting device, the pixel driving circuit and the pixel driving method enable the driving current flowing through the light-emitting device to increase, thereby compensating for attenuation of the display luminance caused by the aging of the light-emitting device.

DETAILED DESCRIPTION

For a better understanding of the technical solutions of the present disclosure by the skilled in the art, detailed depictions will be presented below with respect to the pixel driving circuit, the display device and the pixel driving method according to the present disclosure with reference to the drawings.

[Embodiment 1]

Figure 1:
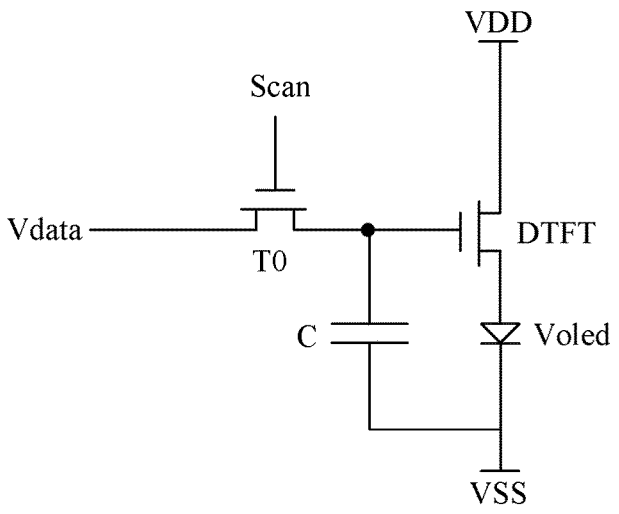
PRIOR ART FIG. 1
FIG. 1 is a structural schematic diagram of a pixel driving circuit in the prior art.
Figure 2:
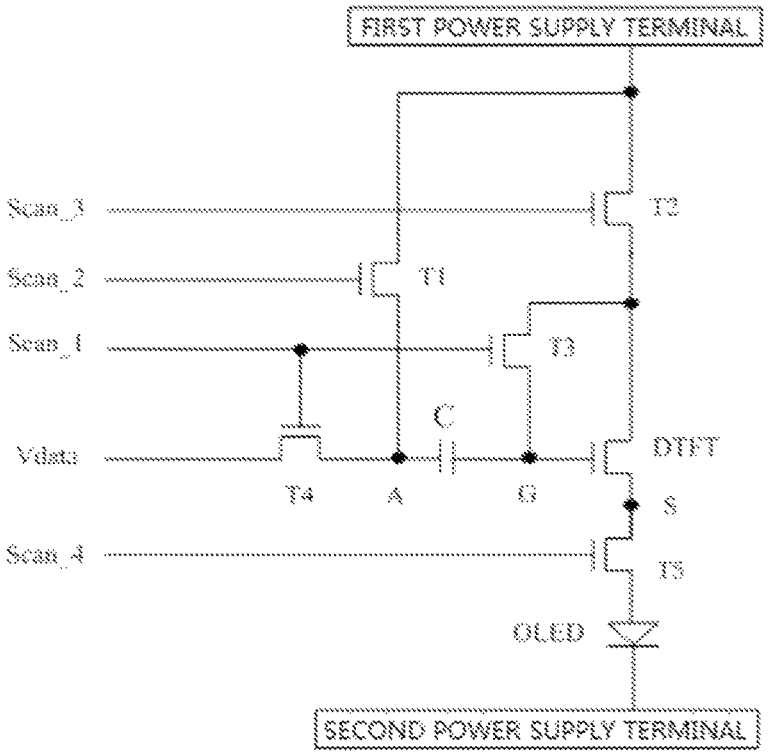
FIG. 2 is a schematic diagram of a pixel driving circuit according to a first embodiment of the present disclosure.

FIG. 2 is a schematic diagram of a pixel driving circuit according to a first embodiment of the present disclosure. As shown in FIG. 2, the pixel driving circuit includes a driving transistor DTFT, a storage capacitor C, a light-emitting device OLED, a first switch transistor T1, a second switch transistor T2, a third switch transistor T3, a fourth switch transistor T4 and a fifth switch transistor T5.

A control electrode of the first switch transistor T1 is connected with a second scanning line Scan_2, a first electrode of the first switch transistor T1 is connected with a first power supply terminal, and a second electrode of the first switch transistor T1 is connected with a first terminal of the storage capacitor C.

A control electrode of the second switch transistor T2 is connected with a third scanning line Scan_3, a first electrode of the second switch transistor T2 is connected with the first power supply terminal, and a second electrode of the second switch transistor T2 is connected with a first electrode of the driving transistor DTFT and a first electrode of the third switch transistor T3.

A control electrode of the third switch transistor T3 is connected with a first scanning line Scan_1, the first electrode of the third switch transistor T3 is connected with the first electrode of the driving transistor DTFT, and a second electrode of the third switch transistor T3 is connected with a control electrode of the driving transistor DTFT and a second terminal of the storage capacitor C.

A control electrode of the fourth switch transistor T4 is connected with the first scanning line Scan_1, a first electrode of the fourth switch transistor T4 is connected with a data line, and a second electrode of the fourth switch transistor T4 is connected with the first terminal of the storage capacitor C.

A control electrode of the fifth switch transistor T5 is connected with a fourth scanning line Scan_4, a first electrode of the fifth switch transistor T5 is connected with a second electrode of the driving transistor DTFT, and a second electrode of the fifth switch transistor T5 is connected with a first terminal of the light-emitting device OLED.

The second terminal of the storage capacitor C is connected with the control electrode of the driving transistor DTFT, and a second terminal of the light-emitting device OLED is connected with a second power supply terminal.

In the present embodiment, the first power supply terminal is used to provide a working voltage Vdd, and the second power supply terminal is used to provide a reference voltage Vss.

It is to be appreciated that although the light-emitting device is illustrated as an OLED in the present embodiment, the light-emitting device may be other electric current-driven light-emitting devices in the prior art, such as a light-emitting diode (LED).

In addition, the driving transistor DTFT, the first switch transistor T1, the second switch transistor T2, the third switch transistor T3, the fourth switch transistor T4 and the fifth switch transistor T5 in the present embodiment are independently selected from a polycrystalline silicon thin film transistor, a noncrystalline silicon thin film transistor, an oxide thin film transistor and an organic thin film transistor.

The "control electrode" as used in the present embodiment specifically refers to a gate of the transistor, the "first electrode" specifically refers to a source of the transistor, and the "second electrode" specifically refers to a drain of the transistor. Of course, those skilled in the art should appreciate that the "first electrode" and "second electrode" are interchangeable.

The pixel driving circuit according to the present embodiment is implemented such that the driving current flowing out of the driving transistor DTFT to drive the light-emitting device OLED to emit light is irrelevant to the threshold voltage Vth of the driving transistor DTFT, thereby compensating for the difference among the diving currents flowing through the light-emitting devices OLED caused by the inconsistency or drifting of the threshold voltage Vth of the driving transistor DTFT, improving the uniformity of light emission luminance of the display device, and substantially boosting the display effect. In addition, since the pixel circuit according to the present embodiment is structurally simple for including a smaller number of switch transistors, an area of a light-shading region covering the driving circuit may be reduced, and an aperture ratio of the display device may be effectively increased.

Operations of the pixel driving circuit according to the present embodiment will be described in detail with reference to FIGS. 2 to 8. In the following depictions, the driving transistor DTFT, the first switch transistor T1, the second switch transistor T2, the third switch transistor T3, the fourth switch transistor T4 and the fifth switch transistor T5 are each illustrated as an N-type thin film transistor.

It is to be appreciated that when the driving transistor DTFT, the first switch transistor T1, the second switch transistor T2, the third switch transistor T3, the fourth switch transistor T4 and the fifth switch transistor T5 are N-type thin film transistors, the switch transistors and the driving transistor DTFT in the pixel driving circuit may be simultaneously manufactured with the same production process, resulting in a simplified production flow and a shortened production cycle.

Figure 3:
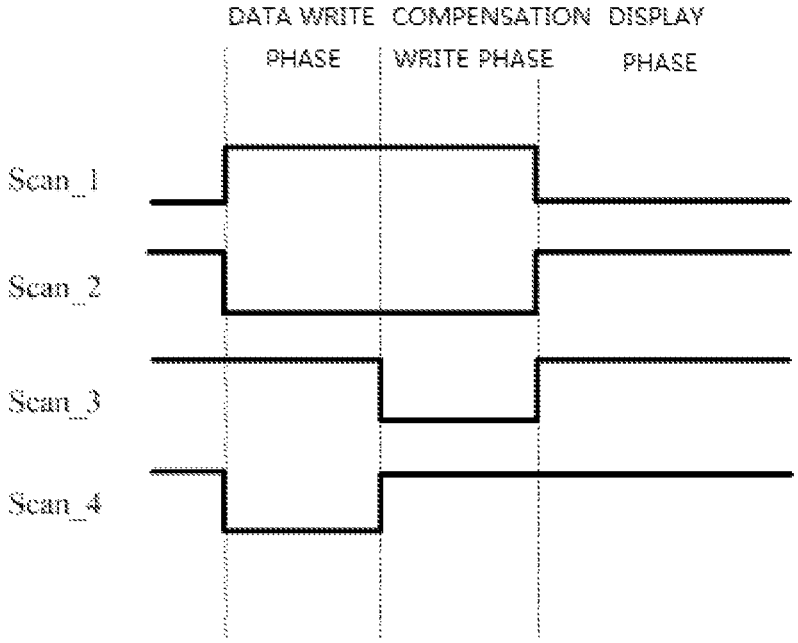
FIG. 3 is a sequence diagram of scanning signals provided by scanning lines in the pixel driving circuit as shown in FIG. 2.

FIG. 3 is a sequence diagram of scanning signals provided by scanning lines in the pixel driving circuit as shown in FIG. 2. As shown in FIG. 3, the working procedure of the pixel driving circuit includes three phases: a data write phase, a compensation write phase and a display phase.

Referring to FIG. 3, in the data write phase, the first scanning line Scan_1 outputs a high level signal, the second scanning line Scan_2 outputs a low level signal, the third scanning line Scan_3 outputs a high level signal, and the fourth scanning line Scan_4 outputs a low level signal. In this case, the first switch transistor T1 and the fifth switch transistor T5 are turned off, and the second switch transistor T2, the third switch transistor T3 and the fourth switch transistor T4 are turned on.

Figure 4:
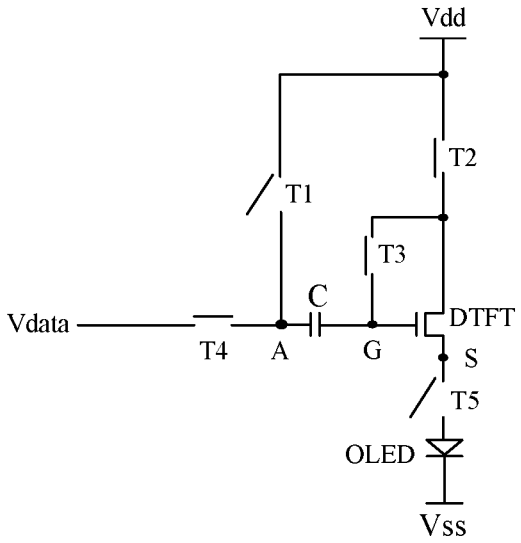
FIG. 4 is an equivalent circuit diagram of the pixel driving circuit shown in FIG. 2 in a data write phase.

FIG. 4 is an equivalent circuit diagram of the pixel driving circuit shown in FIG. 2 in the data write phase. As shown in FIG. 4, since the fourth switch transistor T4 is turned on, a data voltage Vdata in a data line is written to the first terminal of the storage capacitor C through the fourth switch transistor T4. That is, the voltage of node A in the figure is Vdata. Meanwhile, since the second switch transistor T2 and the third switch transistor T3 are also turned on, the working voltage Vdd provided by the first power supply terminal is written to the second terminal of the storage capacitor C through the second switch transistor T2 and the third switch transistor T3. That is, the voltage of node G in the figure is Vdd.

It is to be appreciated that since the voltage of node G is Vdd, the driving transistor DTFT is turned on during the data write phase. However, as the fifth switch transistor T5 is turned off, the driving current flowing out of the driving transistor DTFT does not flow through the light-emitting device OLED, and thus the light-emitting device OLED does not emit light.

Referring back to FIG. 3, in the compensation write phase, the first scanning line Scan_1 outputs a high level signal, the second scanning line Scan_2 outputs a low level signal, the third scanning line Scan_3 outputs a low level signal, and the fourth scanning line Scan_4 outputs a high level signal. In this case, the first switch transistor T1 and the second switch transistor T2 are turned off, and the third switch transistor T3, the fourth switch transistor T4 and the fifth switch transistor T5 are turned on.

Figure 5:
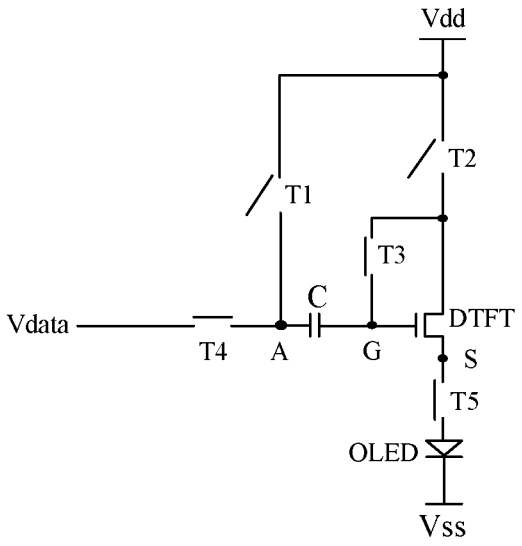
FIG. 5 is an equivalent circuit diagram of the pixel driving circuit shown in FIG. 2 in a compensation write phase.

FIG. 5 is an equivalent circuit diagram of the pixel driving circuit shown in FIG. 2 in the compensation write phase. As shown in FIG. 5, since the fourth switch transistor T4 remains at an ON state, the voltage of the first terminal of the storage capacitor C remains at Vdata, namely, the voltage of node A is Vdata. In addition, since the fifth switch transistor T5 is turned on, the voltage of the second electrode of the driving transistor DTFT is Vss+Voled_0, namely, the voltage of node S is Vss+Voled_0, wherein Voled_0 is an activation voltage (threshold threshold) of the light-emitting device OLED. At the same time, since the second switch transistor T2 is turned off and the third switch transistor T3 remains ON, the control electrode of the driving transistor DTFT is electrically connected with the first electrode, whereupon the driving transistor DTFT corresponds to a PN junction. The driving transistor DTFT discharges quickly until the voltage of the control electrode of the driving transistor DTFT falls to Vss+Voled_0+Vth, in which case the driving transistor DTFT is turned off. Vth is the threshold voltage of the driving transistor DTFT. At this time, the compensation voltage with a magnitude of Vss+Voled_0+Vth is written to the second terminal of the storage capacitor C, namely, the voltage of node G is Vss+Voled_0+Vth. In the compensation write phase, the voltage difference across the storage capacitor C (i.e., $V_{GA}$) is Vss+Voled_0+Vth−Vdata.

It is to be appreciated that although the fifth switch transistor T5 in the compensation write phase is in an ON state, since the driving transistor DTFT will quickly get into an OFF state as discharging quickly, no driving current will flow out, namely, the light-emitting device OLED will not emit light.

Referring back to FIG. 3, in the display phase, the first scanning line Scan_1 outputs a low level signal, the second scanning line Scan_2 outputs a high level signal, the third scanning line Scan_3 outputs a high level signal, and the fourth scanning line Scan_4 outputs a high level signal. In this case, the third switch transistor T3 and the fourth switch transistor T4 are turned off, and the first switch transistor T1, the second switch transistor T2 and the fifth switch transistor T5 are turned on.

Figure 6:
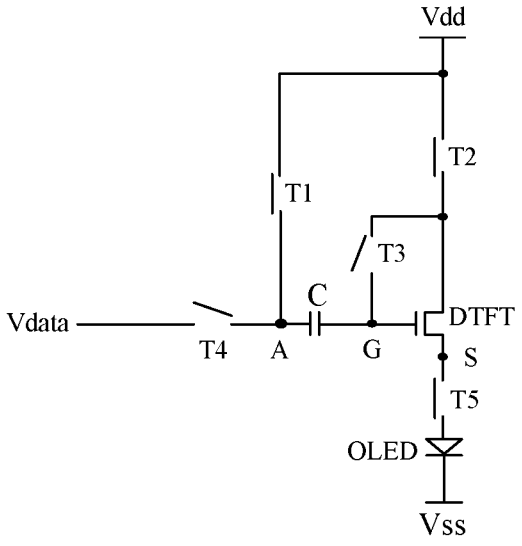
FIG. 6 is an equivalent circuit diagram of the pixel driving circuit shown in FIG. 2 in a display phase.

FIG. 6 is an equivalent circuit diagram of the pixel driving circuit shown in FIG. 2 in the display phase. As shown in FIG. 6, since the fourth switch transistor T4 is turned off and the first switch transistor T1 is turned on, the working voltage Vdd provided by the first power supply terminal is written to the first terminal of the storage capacitor C through the first switch transistor T1, whereupon the voltage of the first terminal of the storage capacitor C is Vdd, namely, the voltage of node A becomes Vdd. The change in the voltage of the first terminal of the storage capacitor C causes a bootstrap effect, by which the voltage difference across both ends of the storage capacitor C is maintained at Vss+Voled_0+Vth−Vdata. Thus, the voltage of the second terminal of the storage capacitor C jumps to Vss+Voled_0+Vth+Vdd−Vdata, namely, the voltage of node G jumps to Vss+Voled_0+Vth+Vdd−Vdata.

In the display phase, the second terminal of the storage capacitor C outputs a control voltage to the driving transistor DTFT, the control voltage is equal to Vss+Voled_0+Vth+Vdd−Vdata, and the driving transistor DTFT is turned on under control of the control voltage and thereby generates a driving current to drive the light-emitting device OLED to emit light. As the light-emitting device OLED emits light, the voltage of node S becomes Vss+Voled_1, wherein Voled_1 is the working voltage when the light-emitting device OLED emits light.

The following may be obtained from a saturated driving current formula of the driving transistor DTFT:

$$I = K*(Vgs - Vth)^2$$

$$= K*[Vss + \text{Voled_0} + Vth + Vdd - Vdata - (Vss + \text{Voled_1}) - Vth]^2$$

$$= K*(Vdd + \text{Voled_0} - \text{Voled_1} - Vdata)^2$$

wherein K is a constant, and Vgs is a gate-source voltage of the driving transistor DTFT (i.e., a voltage between the control electrode and the second electrode of the driving transistor DTFT). As can be known from the above formula, the driving current of the driving transistor DTFT is relevant to the working voltage Vdd provided by the first power supply terminal, the activation voltage Voled_0 of the light-emitting device OLED, the working voltage Voled_1 of the light-emitting device OLED upon emitting light, and the data voltage Vdata, and is not relevant to the threshold voltage Vth of the driving transistor DTFT. In the present embodiment, when the driving transistor DTFT drives the light-emitting device OLED to perform pixel display, the driving current of the driving transistor DTFT is irrelevant to the threshold voltage Vth of the driving transistor DTFT, thereby refraining the driving current flowing through the light-emitting device OLED from influence exerted by the non-uniformity and drifting of the threshold voltage Vth of the driving transistor DTFT, and thereby effectively improving the uniformity of the driving current flowing through the light-emitting device OLED. In addition, when the activation voltage of the light-emitting device OLED increases (namely, Voled_0 becomes larger) as the light-emitting device OLED ages, the pixel driving circuit enables the driving current flowing through the light-emitting device OLED to increase, thereby compensating for attenuation of the display luminance caused by the aging of the light-emitting device OLED.

Figure 7:
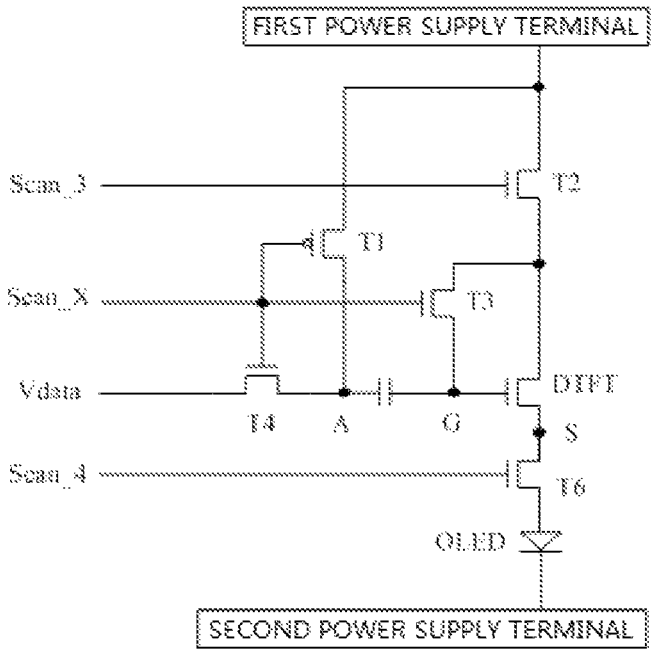
FIG. 7 is a schematic diagram of another pixel driving circuit according to a first embodiment of the present disclosure.
Figure 8:
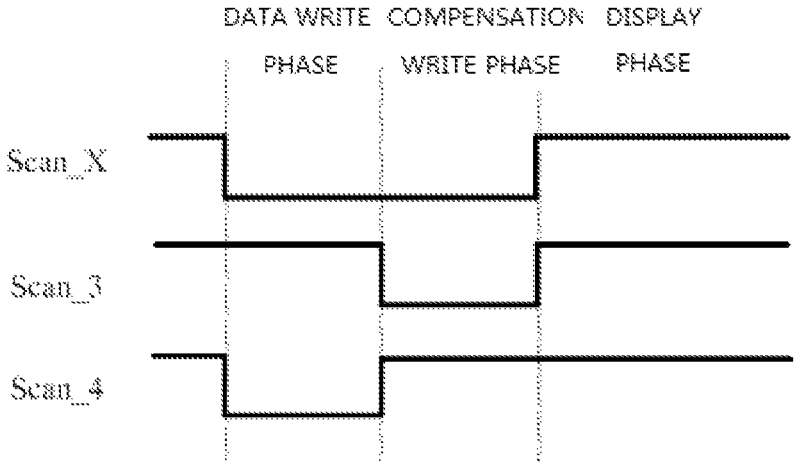
FIG. 8 is a sequence diagram of scanning signals provided by scanning lines in the pixel driving circuit as shown in FIG. 7.

FIG. 7 is a schematic diagram of another pixel driving circuit according to the first embodiment of the present disclosure, and FIG. 8 is a sequence diagram of scanning signals provided by scanning lines in the pixel driving circuit as shown in FIG. 7. The pixel driving circuit shown in FIG. 7 differs from the pixel driving circuit shown in FIG. 2 in that in the pixel driving circuit shown in FIG. 7, the first switch transistor T1 is a P-type thin film transistor, the second switch transistor T2, the third switch transistor T3, the fourth switch transistor T4 and the fifth switch transistor T5 are N-type thin film transistors, and that the first scanning line Scan_1 and the second scanning line Scan_2 are the same scanning line Scan_X.

The working procedure of the pixel driving circuit shown in FIG. 7 is similar to the working procedure of the pixel driving circuit shown in FIG. 2, and will not be detailed here.

In FIG. 7, the first switch transistor T1, the third switch transistor T3 and the fourth switch transistor T4 may be controlled using the same scanning line Scan_X. This may effectively reduce the number of signal wirings (i.e., scanning lines) in the driving circuit and thereby simplify the structure of the pixel-driving circuit.

[Embodiment 2]

Embodiment 2 of the present disclosure provides a display device which includes a pixel driving circuit. The pixel driving circuit employs the pixel driving circuit provided by the above Embodiment 1. Reference may be made to the depictions with respect to Embodiment 1 for details, and thus no specifics will be discussed here.

[Embodiment 3]

Embodiment 3 of the present disclosure provides a pixel driving method which is based on a pixel driving circuit. The pixel driving circuit employs the pixel driving circuit provided by the above Embodiment 1. Reference may be made to the depictions in Embodiment 1 for details.

The pixel driving method includes a data write phase, a compensation write phase and a display phase.

In the data write phase, the first switch transistor T1 and the fifth switch transistor T5 are turned off, and the second switch transistor T2, the third switch transistor T3 and the fourth switch transistor T4 are turned on. A data voltage Vdata in a data line is written to the first terminal of the storage capacitor C through the fourth switch transistor T4, and the working voltage provided by the first power supply terminal is written to the second terminal of the storage capacitor C through the second switch transistor T2 and third switch transistor T3.

Reference may be made to the description with respect to FIG. 4 and the above Embodiment 1 for details of the data write phase.

In the compensation write phase, the first switch transistor T1 and the second switch transistor T2 are turned off, and the third switch transistor T3, the fourth switch transistor T4 and the fifth switch transistor T5 are turned on. The driving transistor DTFT discharges to write a compensation voltage including the threshold voltage Vth of the driving transistor DTFT to the second terminal of the storage capacitor C.

In the compensation write phase, the magnitude of the compensation voltage is Vss+Voled_0+Vth. Reference may be made to the description with respect to FIG. 5 and the above Embodiment 1 for details of the compensation write phase.

In the display phase, the third switch transistor T3 and the fourth switch transistor T4 are turned off, and the first switch transistor T1, the second switch transistor T2 and the fifth switch transistor T5 are turned on. The working voltage provided by the first power supply terminal is written to the first terminal of the storage capacitor C through the first switch transistor T1, the second terminal of the storage capacitor C outputs a control voltage to the driving transistor DTFT, and the driving transistor DTFT generates a driving current under control of the control voltage to drive the light-emitting device OLED to emit light.

In the display phase, the magnitude of the control voltage output by the second terminal of the storage capacitor C to the driving transistor DTFT is Vss+Voled_0+Vth+Vdd−Vdata, and the magnitude of the driving current generated by the driving transistor DTFT is K*(Vdd+Voled_0−Voled_1−Vdata)$^2$, wherein Voled_0 is the activation voltage of the light-emitting device OLED, and Voled_1 is a working voltage of the light-emitting device OLED upon emitting light. Reference may be made to the description with respect to FIG. 6 and the above Embodiment 1 for details of the display phase.

Embodiment 3 of the present disclosure provides a pixel driving method which is implemented such that when the driving transistor DTFT drives the light-emitting device OLED to perform pixel display, the driving current of the driving transistor DTFT is irrelevant to the threshold voltage Vth of the driving transistor DTFT, thereby refraining the driving current flowing through the light-emitting device OLED from influence exerted by the non-uniformity and drifting of the threshold voltage Vth of the driving transistor DTFT, and thereby effectively improving the uniformity of the driving current flowing through the light-emitting device OLED. In addition, when the activation voltage of the light-emitting device OLED increases (namely, Voled_0 becomes larger) as the light-emitting device OLED ages, the pixel driving method enables the driving current flowing through the light-emitting device OLED to increase, thereby compensating for attenuation of the display luminance caused by the aging of the light-emitting device.

It can be appreciated that the above embodiments are only exemplary embodiments for illustration of the principle of the present disclosure; the present disclosure is not limited thereto. Various variations and improvements can be made by those having ordinary skill in the art without departing from the spirit and essence of the present disclosure, and these variations and improvements are also considered as falling within the scope of the present disclosure.

What is claimed is:

1. A method of driving a pixel driving circuit, the pixel driving circuit comprising a driving transistor, a storage capacitor, a light-emitting device, a first switch transistor, a second switch transistor, a third switch transistor, a fourth switch transistor and a fifth switch transistor, wherein a control electrode of the first switch transistor is connected with a second scanning line, a first electrode of the first switch transistor is connected with a first power supply terminal, and a second electrode of the first switch transistor is connected with a first terminal of the storage capacitor;

a control electrode of the second switch transistor is connected with a third scanning line, a first electrode of the second switch transistor is connected with the first power supply terminal, and a second electrode of the second switch transistor is connected with a first electrode of the driving transistor and a first electrode of the third switch transistor;

a control electrode of the third switch transistor is connected with a first scanning line, the first electrode of the third switch transistor is connected with the first electrode of the driving transistor, and a second electrode of the third switch transistor is connected with a control electrode of the driving transistor and a second terminal of the storage capacitor;

a control electrode of the fourth switch transistor is connected with the first scanning line, a first electrode of the fourth switch transistor is connected with a data line, and a second electrode of the fourth switch transistor is connected with the first terminal of the storage capacitor;

a control electrode of the fifth switch transistor is connected with a fourth scanning line, a first electrode of the fifth switch transistor is connected with a second electrode of the driving transistor, and a second electrode of the fifth switch transistor is connected with a first terminal of the light-emitting device;

the second terminal of the storage capacitor is connected with the control electrode of the driving transistor, and a second terminal of the light-emitting device is connected with a second power supply terminal; and the first power supply terminal is used to provide a working voltage, and the second power supply terminal is used to provide a reference voltage, the method comprising:

performing a data write phase in which the first switch transistor and the fifth switch transistor are turned off, the second switch transistor, the third switch transistor and the fourth switch transistor are turned on, a data voltage on the data line is written to the first terminal of the storage capacitor through the fourth switch transistor, and the working voltage provided by the first power supply terminal is written to the second terminal of the storage capacitor through the second switch transistor and the third switch transistor, performing a compensation write phase in which the first switch transistor and the second switch transistor are turned off, the third switch transistor, the fourth switch transistor and the fifth switch transistor are turned on, and the driving transistor discharges to write a compensation voltage including a threshold voltage of the driving transistor to the second terminal of the storage capacitor; and performing a display phase in which the third switch transistor and the fourth switch transistor are turned off, the first switch transistor, the second switch transistor and the fifth switch transistor are turned on, the working voltage provided by the first power supply terminal is written to the first terminal of the storage capacitor through the first switch transistor, a control voltage is output from the second terminal of the storage capacitor to the driving transistor, and the driving transistor generates a driving current under control of the control voltage to drive the light-emitting device to emit light.

2. The method of claim 1, wherein each of the driving transistor, the first switch transistor, the second switch transistor, the third switch transistor, the fourth switch transistor and the fifth switch transistor is selected from the group consisting of a polycrystalline silicon thin film transistor, a noncrystalline silicon thin film transistor, an oxide thin film transistor and an organic thin film transistor.

3. The method of claim 1, wherein the driving transistor is an N-type thin film transistor.

4. The method of claim 3, wherein the first switch transistor, the second switch transistor, the third switch transistor, the fourth switch transistor and the fifth switch transistor each are an N-type thin film transistor.

5. The method of claim 3, wherein the first switch transistor is a P-type thin film transistor, the second switch transistor, the third switch transistor, the fourth switch transistor and the fifth switch transistor each are an N-type thin film transistor, and the first scanning line and the second scanning line are the same scanning line.

* * * * *